US008776492B2

(12) United States Patent
Knuchel

(10) Patent No.: US 8,776,492 B2
(45) Date of Patent: Jul. 15, 2014

(54) ADJUSTABLE LINK

(75) Inventor: Daniel Knuchel, Biel (CH)

(73) Assignee: Omega SA, Biel/Bienne (CH)

( * ) Notice: Subject to any disclaimer, the term of this patent is extended or adjusted under 35 U.S.C. 154(b) by 0 days.

(21) Appl. No.: 13/981,537

(22) PCT Filed: Feb. 1, 2012

(86) PCT No.: PCT/EP2012/051699

§ 371 (c)(1),
(2), (4) Date: Aug. 22, 2013

(87) PCT Pub. No.: WO2012/104352

PCT Pub. Date: Aug. 9, 2012

(65) Prior Publication Data

US 2013/0319042 A1 Dec. 5, 2013

(30) Foreign Application Priority Data

Feb. 2, 2011 (EP) ..... 11153039

(51) Int. Cl.
*F16G 13/00* (2006.01)
*A44C 5/04* (2006.01)

(52) U.S. Cl.
USPC ..... 59/79.3; 59/79.1; 59/80; 59/85

(58) Field of Classification Search
USPC ..... 59/79.1, 79.2, 79.3, 80, 84, 85, 93; 63/5.1, 6, 9
See application file for complete search history.

(56) References Cited

U.S. PATENT DOCUMENTS 1,532,334 A * 4/1925 Nelson ..... 59/79.3
1,564,563 A * 12/1925 Art ..... 59/79.3
1,641,763 A * 9/1927 Jones ..... 59/79.1
1,659,990 A * 2/1928 Boots ..... 59/79.3
2,429,393 A * 10/1947 Cedar ..... 59/79.3
2,889,681 A * 6/1959 Augenstein ..... 59/82
2,943,437 A * 7/1960 Ihringer ..... 59/79.3
3,038,296 A * 6/1962 Obst ..... 59/79.3
5,623,838 A 4/1997 Cuche
6,978,596 B1 * 12/2005 Lee ..... 59/79.3

FOREIGN PATENT DOCUMENTS

| | | |
|---|---|---|
| CH | 695 656 | 7/2006 |
| EP | 0 737 427 | 10/1996 |
| FR | 2 670 995 | 7/1992 |

OTHER PUBLICATIONS

International Search Report Issued Mar. 22, 2012 in PCT/EP12/051699 Filed Feb. 1, 2012.

* cited by examiner

*Primary Examiner* — David B Jones
(74) *Attorney, Agent, or Firm* — Oblon, Spivak, McClelland, Maier & Neustadt, L.L.P.

(57) ABSTRACT

An adjustable link for a bracelet, including first and second half links longitudinally moveable via cooperation of a guide and a complementary guide, and captived by cooperation of a stopping mechanism and a complementary stopping mechanism. The first half link includes a longitudinal finger with a locking mechanism including a radial elastic return moveable between folded and unfolded positions, and the second half link includes a longitudinal channel allowing the finger to pass in only one of the folded or unfolded positions, and, in proximity to the channel, a complementary locking mechanism cooperating, in at least one locking position, with the locking mechanism in the other of the folded or unfolded positions, the locking mechanism and complementary locking mechanism together defining at least two of the longitudinally separate locking positions.

16 Claims, 11 Drawing Sheets

Fig. 2
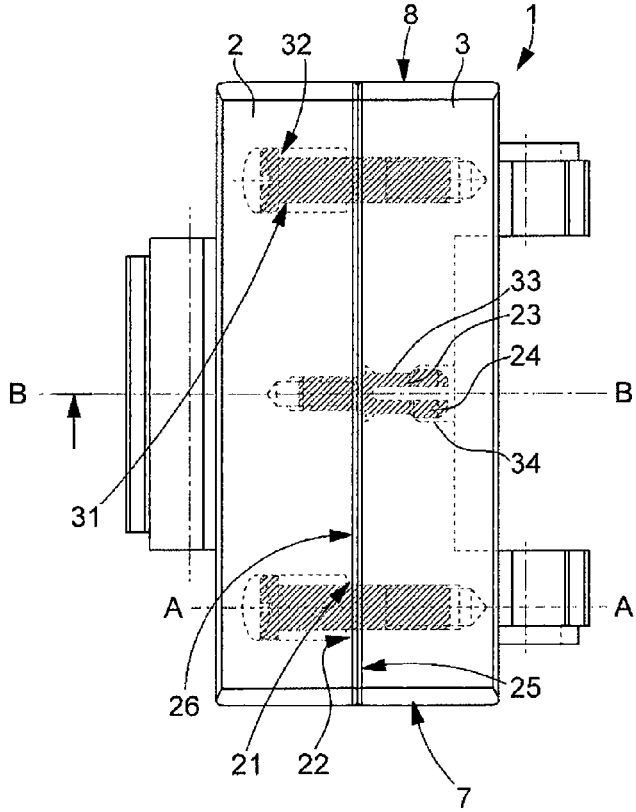
Fig.1
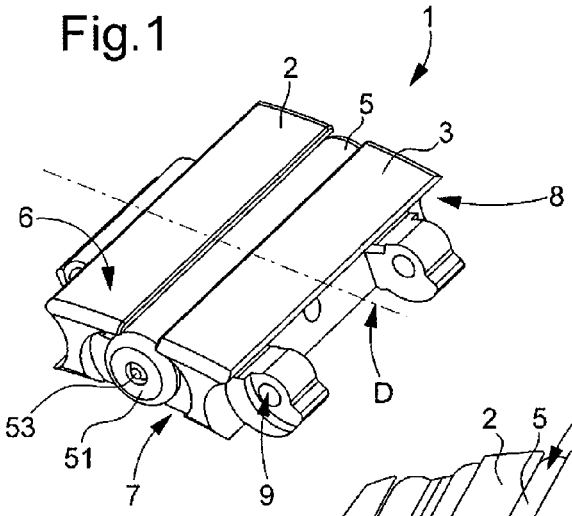
Fig. 9
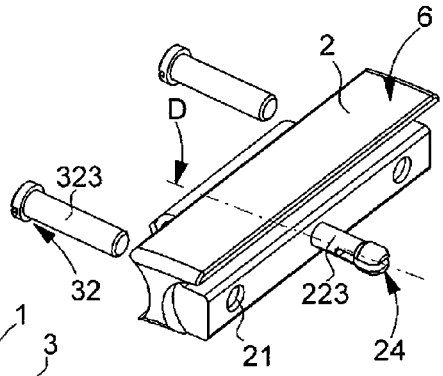
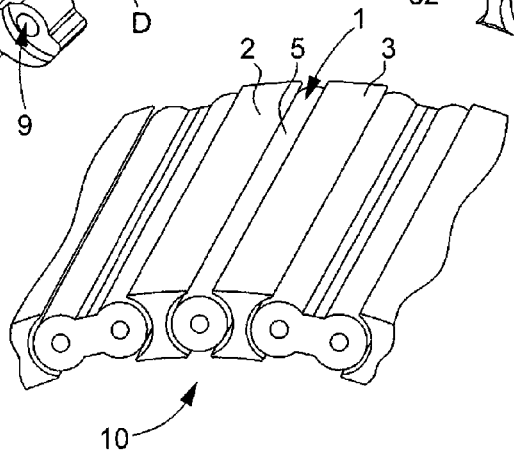
Fig. 11

ADJUSTABLE LINK

FIELD OF THE INVENTION

The invention concerns an adjustable link for a bracelet, including at least one first half-link and at least one second half-link which are moveable in relation to each other in one direction and which together form an assembly wherein both half links cannot be separated called hereinafter a captive unit?

The invention also concerns a bracelet including at least two bracelet strands.

The invention concerns the field of adjustable fastenings, in particular for objects intended to be worn on a human or animal body. The invention concerns in particular fastenings for bracelets, belts, straps, harnesses and similar objects, used in particular in the field of jewellery, leather goods, or even saddlery.

BACKGROUND OF THE INVENTION

Bracelets, necklaces, belts, straps and similar objects are generally fastened in an adjustable manner in predetermined positions, which allow precise re-positioning, and which the user can adjust via the cooperation of a finger with one hole among a plurality of holes, or by hooking a pin onto a rack, or a similar device. Continuous fastenings which maintain position using friction do not offer the possibility of precise re-positioning.

It is often necessary to have an adjustable length fastening, for example between two predetermined positions, to take account of climatic factors or the morphology or comfort of the user.

CH Patent No 699067 in the name of ELFIX PRODUCTION SA discloses a device for finely adjusting the length of a bracelet integrated in a clasp cover, and comprising a device for indexing in two predefined positions, and which includes spring ball push buttons, which are captived to a transverse bar, connected to one end of the bracelet and arranged to cooperate with pierced holes provided in the clasp cover.

EP Patent No 0 737 427 in the name of THE SWATCH GROUP MANAGEMENT SERVICES AG and CH Patent No 695 656 in the name of WERTHANOR SA disclose adjustable links for watch wristlets or bracelets, wherein adjustment is performed by actuating an unlocking button to change from one length indexing position to another.

FR Patent No 2 670 995 in the name of PERILLAT COLOMB discloses a bar which extends in the longitudinal direction of a bracelet, and whose ends are each engaged in a link portion in predefined indexing positions, either by spring bars, or by studs cooperating with holes provided in the bar. A tool has to be used to change from one position to another. These indexing devices extend transversely and require a significant amount of space. They are also visible and detract from the general attractiveness of the bracelet.

These known devices act transversely, generally require a tool to perform the adjustment, and remain visible.

SUMMARY OF THE INVENTION

It is an object of the invention to propose a more compact solution than prior art solutions, acting in the longitudinal direction of the bracelet, using an adjustable mechanism with no particular tools, wherein the adjustment mechanism remains concealed and comprises a return means for returning the adjustable link to a shortened position.

The invention therefore concerns an adjustable link for a bracelet, comprising at least one first half link and at least one second half link, which are moveable in relation to each other in one direction and which form a captive unit, characterized in that:

- said first half link either comprises at least one connecting and locking member, or is assembled fixedly or with restricted mobility in said direction with at least one connecting and locking member; said connecting and locking member extending in said direction and comprising a locking means,
- said second half link either includes a complementary locking means or is assembled fixedly or with restricted mobility in said direction with a complementary locking means,
- said locking means and said complementary locking means together define at least two locking positions for immobilising said first half link with respect to said second half link, said positions being discrete and separated from each other in said direction,
- said locking means and/or said complementary locking means are moveable, under the action of a force that is exerted in said direction and is greater than a given value, against elastic return means respectively comprised in said complementary locking means and/or said locking means, to allow a relative change of position between said first half link and said second half link in said direction.

According to a feature of the invention, said at least one first half link and said at least one second half link are guided in relation to each other via the cooperation of a guide means and a complementary guide means, and form a captive unit via the cooperation of an stopping means and a complementary stopping means, and said connecting and locking member comprises at least one finger which extends in said direction and which comprises a locking means having substantially radial elastic return relative to said direction and which is moveable between a folded position and an unfolded position, and said second half link includes at least one channel extending in said direction and arranged to allow said finger to pass into only one of said folded or unfolded positions of said locking means, and in proximity to said channel, said second half link further includes a complementary locking means arranged to cooperate, in at least one locking position, with said locking means in the other of said unfolded or folded positions of said locking means, and said locking means and said complementary locking means together define at least two said discrete and separate locking positions in said direction.

According to another feature of the invention, said first half link and said second half link form a frame around a central body which incorporates the entire adjustment mechanism, and at least said first half link or said second half link includes at least one guide means formed by at least one finger comprising stopping means, and carrying at least one locking means including at least one elastic O-ring joint, which is mounted in a groove of said finger and which cooperates in abutment with at least one complementary locking means formed by a rib carried by said central body, defining a lateral housing on each side of said rib, in which said joint can be stopped on one side or other of said rib.

According to another feature of the invention, said first half-link and said second half-link form a frame around a central body which incorporates the entire adjustment mechanism, and said adjustable link comprises at least one elastic locking element, formed by a flat wedge spring in the shape of a single or double arrow, comprising at least one elastic slot, and comprising at least one corner fastening for said first half link and comprising a front elastically deformable portion opposite said at least one slot and which comprises at least one corner adjustment cooperating with an adjustment notch of said second half link among a plurality of adjustment notches carried by said second half link, the change from one notch to another being possible by the compression of said wedge resulting from a traction or thrust force in said direction.

The invention further concerns a bracelet including at least two bracelet strands, characterized in that it comprises at least one adjustable link, fastened to the bracelet strands via a fastening means.

BRIEF DESCRIPTION OF THE DRAWINGS

Other features and advantages of the invention will appear more clearly upon reading the following detailed description, with reference to the annexed drawings, in which:

FIG. 1 shows a schematic perspective view of a first variant of an adjustable link according to the invention, locked in first unfolded position.

FIG. 2 shows a schematic top view of the adjustable link of FIG. 1, locked in a folded position.

FIG. 9 shows a schematic, perspective view of a half link of the adjustable link of FIG. 1, shown with a locking finger in the assembled position, and an exploded view with a complementary guide means to be captived to another half link, arranged to be inserted into a guide means visible on the face carrying the locking finger.

FIG. 11 shows a schematic, perspective view of a bracelet incorporating an adjustable link according to the invention.

DETAILED DESCRIPTION OF PREFERRED EMBODIMENTS

Figure 3:
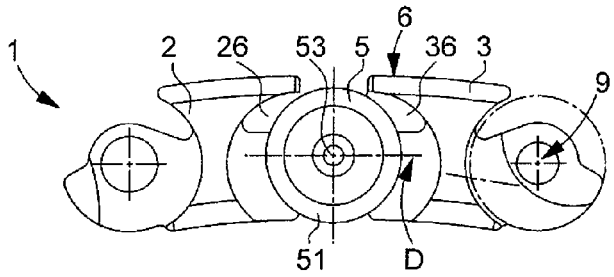
FIG. 3 shows a schematic side view of the adjustable link of FIG. 1, in the unfolded position.
Figure 4:
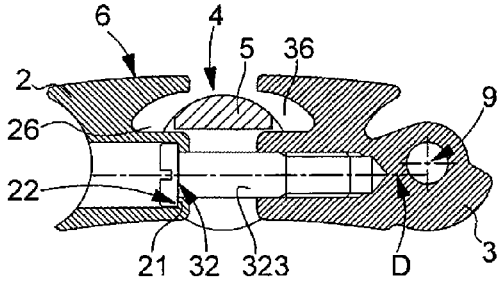
FIG. 4 shows a schematic, longitudinal cross-section, along section AA of FIG. 2, of the adjustable link of FIG. 1 in the unfolded position.

The invention further concerns an adjustable link 1 for a bracelet 10.

The invention concerns the field of adjustable fastenings, in particular for objects intended to be worn on a human or animal body. The invention concerns in particular fastenings for bracelets, necklaces, belts, straps, harnesses and similar objects, used in particular in the field of jewellery, leather goods, or even saddlery.

These objects, which differ in size or detailed shape but operate in a similar manner, will be referred to below by the single term “bracelet”.

As seen in FIG. 2, this adjustable link 1 includes at least one first half link 2 and at least one second half link 3, which are arranged to be moveably assembled in relation to each other in a direction of mobility D, via the cooperation of a guide means 21 and a complementary guide means 31.

The invention is described here for the simplified and non-limiting case of two complementary half links which are moveable in relation to each other, and it is naturally possible to make an adjustable link according to the invention which comprises more elements which can be moved in relation to each other.

Figure 12:
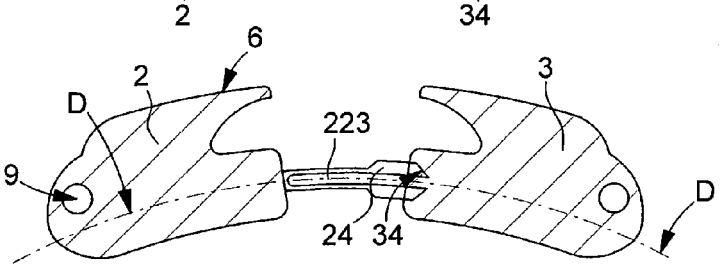
FIG. 12 shows a schematic, partial view similar to FIG. 5 of a variant of the invention having mobility in a curvilinear direction.
Figure 13:
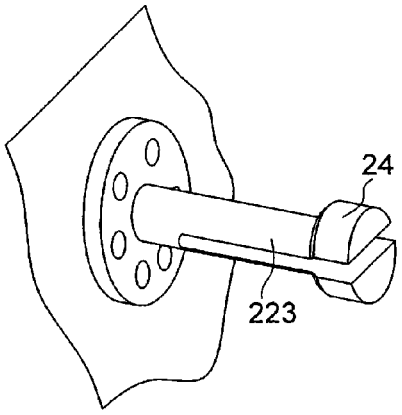
FIG. 13 shows a schematic, perspective view of a detail of a variant of the invention.

This direction of mobility D may be linear, as shown in particular in FIGS. 1 to 10, or curvilinear, as seen in FIG. 12, which may be advantageous for bracelets with a small radius of curvature, particularly for ladies' or children's bracelets.

This first half link 2 and second half link 3 together form a captive unit as a result of stop elements limiting their travel relative to each other, either directly, or with respect to at least one intermediate element, such as a masking element 5, or a central body 100 according to variants of the invention explained below.

According to the invention, the first half link 2 either comprises at least one connecting and locking member 23, or is assembled fixedly or with restricted mobility in direction D with at least one connecting and locking member 23. This connecting and locking member 23 extends in direction D and comprises a locking means 24.

The second half link 3 either includes a complementary locking means 34 or is assembled fixedly or with restricted mobility in direction D with a complementary locking means 34.

Locking means 24 and complementary locking means 34 together define at least two locking positions immobilising the first half link 2 with respect to the second half link 3. These positions are discrete and separated from each other in direction D.

Locking means 24 and/or complementary locking means 34 are moveable, under the action of a force which is exerted in direction D and which is greater than a given value, against elastic return means respectively comprised in complementary locking means 34 and/or locking means 24, to allow a relative change of position between first half link 2 and second half link 3 in direction D. It is clear that the force to be applied in direction D depends on the intensity and angle of application of the resistant force exerted by the elastic return means. The elastic return means must be sized to enable adjustable link 1 to be operated, for a change of adjustment position, by one hand of the user and thus with a moderate force, but also so as to ensure the link remains in the position selected by the user regardless of any movements by the user or his clothes.

In a particular embodiment, particularly according to FIGS. 18 to 23, the second half link 3 includes at least one recess 33 extending in direction D and arranged to allow at least one connecting and locking member 23 to pass and be held in only one of these discrete locking positions. Complementary locking means 34 is preferably arranged in proximity to this channel 33.

Figure 23:
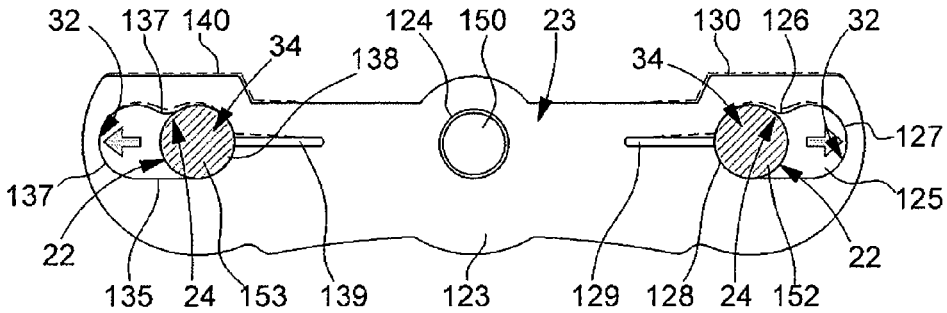
FIG. 23 shows a schematic side view of a detail of the adjustable link of FIG. 18, comprising two transverse pins cooperating with a lateral flange spring, in the unrestrained state in a full line, and under elastic deformation in a dotted line.

In this same embodiment of FIGS. 18 to 23, connecting and locking member 23 includes at least one flange 123 which extends in a plane parallel to direction D, and which includes at least one oblong hole 135 extending in direction D. This flange 123 includes at least one constricted portion 137 on either side of which hole 135 delimits two chambers, each capable of housing a pin 153 with minimum play. This hole 135 is made in an elastically deformable area of flange 123, to allow a pin 153 to pass through constricted portion 137 when subjected to a force, imparted by the user on a half link carrying said pin 153, in direction D against constricted portion 137. This force is of sufficient intensity to overcome the elastic return force exerted on pin 153 by the constricted portion and hole 135. Pin 135 and hole 135 together form locking means 24 and complementary locking means 34. FIG. 23 illustrates the rest state of flange 123 in a full line, and, in a dotted line, the deformation of the flange as a result of the application of a force in direction D, which pushes back constricted portion 137 substantially perpendicularly to direction D, to allow the pin to pass therethrough.

In the preferred embodiment of FIG. 23, flange 123 comprises at least one other oblong hole 125 extending in direction D and including at least one constricted portion 127 on either side of which hole 125 delimits two chambers, each capable of housing another pin 152, then captived to the other half link, with minimum play. Likewise, hole 125 is made in an elastically deformable area of flange 123 to allow pin 152 to pass through constricted portion 127 when the pin is subjected to a force in direction D against constricted portion 127. The force is of sufficient intensity to overcome the elastic return force exerted on pin 152 by the constricted portion and hole 125. This pin 152 and hole 125 together form a means of assembling the first half link 2 with connecting and locking member 23 comprising flange 123 with restricted mobility, in discrete positions in direction D.

Preferably, the second half link 3 comprises, on the opposite side to first half link 2, at least one cap 90 comprising a bore 9 for receiving this type of pin 153 with minimum play, so as to trap flange 123 inside said recess 33, in one of the discrete locking positions. This same pin 153 also forms a hinge pin for one end of a bracelet. The first half link 2 comprises at least one recess 33 extending in direction D and arranged to allow connecting and locking member 23, or flange 123 to pass therethrough. Like second half link 3, first half link 2 comprises, on the side opposite half link 3, at least one cap 91 comprising a bore 9 for receiving a pin 152 with minimum play, so as to trap flange 123 inside recess 33 in one of its discrete positions. Pin 152 also forms a hinge pin for one end of a bracelet.

Advantageously according to the invention, in order to protect the adjustment mechanism and to conceal said mechanism in the various adjustment positions, adjustable link 1 comprises at least one masking element 5 which is confined between first half link 2 and second half link 3, and abuts on at least one said connecting and locking member 23. Preferably, masking element 5 is held on member 23, or members 23 if there are several of them, as in the version illustrated in FIGS. 18 to 22, where two parallel flanges 123 form adjustment member 23, by at least one pin 150 passing through both masking element 5 and connecting and locking member 23, either directly or via a ring or tube 151.

In order to stabilise the bracelet, to position masking element 5 properly on the top portion of the half links visible to the user, and to maintain a certain alignment between the links adjacent to adjustable link 1 and said adjustable link, with limited angular play allowed by the articulation between them, first half link 2 and/or second half link 3 comprises at least one bearing surface 92 pushing pin 150 and/or masking element 5 against top lips 93, 94, respectively comprised in first half link 2 and second half link 3.

Preferably, first half link 2 and second half link 3 are symmetrical relative to a median plane P extending in direction D, and link 1 comprises connecting and locking members 23 symmetrically mounted in relation to median plane P. This first half link 2 and second half link 3 are also assembled so as to form a captive unit, via the cooperation between stopping means 22 and complementary stopping means 32.

In a particular embodiment, particularly in FIGS. 1 to 17, first half link 2 comprises at least one finger 223 which extends in direction D and comprises locking means 24 with substantially radial elastic return relative to direction D. This locking means 24 is moveable between a folded position and an unfolded position.

The second half link 3 includes, in a complementary manner, at least one channel 33 which extends in direction D and is arranged to allow finger 223 to pass, in only one of the folded or unfolded positions of locking means 24 of finger 223 corresponding to said channel 33. Naturally, there are at least as many channels 33 in second half link 3 as there are fingers 223 in first half link 2.

In proximity to each channel 33, second half link 3 further comprises a complementary locking means 34, which is arranged to cooperate in at least one locking position with locking means 24 of the finger 223 corresponding to the channel 33 concerned, in the other, unfolded or folded position of said locking means 24.

Figure 5:
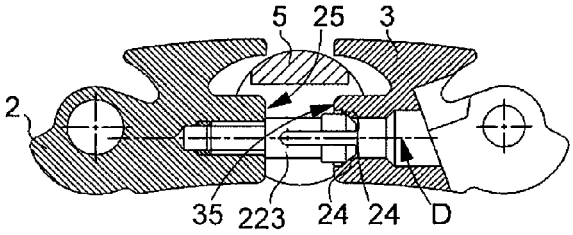
FIG. 5 shows a schematic, longitudinal cross-section, along section BB of FIG. 2, of the adjustable link of FIG. 1 in the unfolded position.
Figure 6:
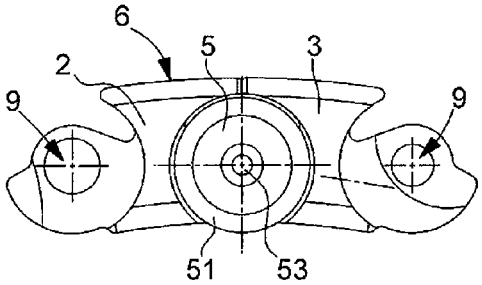
FIG. 6 shows a schematic side view of the adjustable link of FIG. 1, in the folded position.
Figure 7:
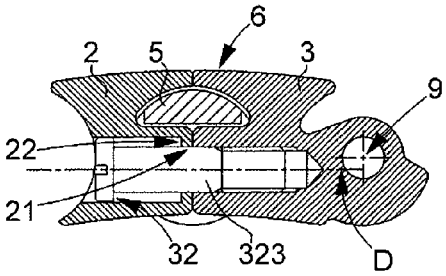
FIG. 7 shows a schematic, longitudinal cross-section, along section AA of FIG. 2, of the adjustable link of FIG. 1 in the folded position.
Figure 8:
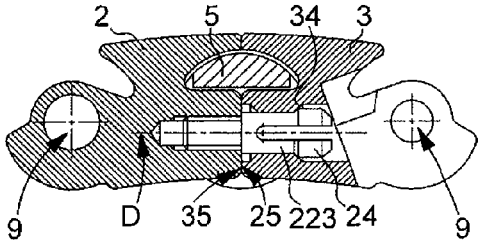
FIG. 8 shows a schematic, longitudinal cross-section, along section BB of FIG. 2, of the adjustable link of FIG. 1 in the folded position.

As shown in FIGS. 5 and 8, in an economical embodiment, finger 223 comprises a head whose diameter is greater than that of channel 33, at the end of a body whose diameter is smaller than or equal to that of channel 33. Said head is slit and it is the slot which gives it elasticity. The body may also be slit, as shown in the Figures. Locking means 24 comprises an entry cone in at least one direction, and preferably in both directions of motion of finger 223. Complementary locking means 34 comprises at least one groove with an entry ramp whose angle of taper is close to that of the head of finger 223.

These ramps or entry cones enable adjustable link 1 to be handled without excessive force, to change from one locking position to another.

In a variant of the invention, which is not described in detail here since it is accessible to any engineer, and whose operation is similar but reversed, the elastic return means is not located on finger 223, which is then rigid, but in channel 33.

Figure 15:
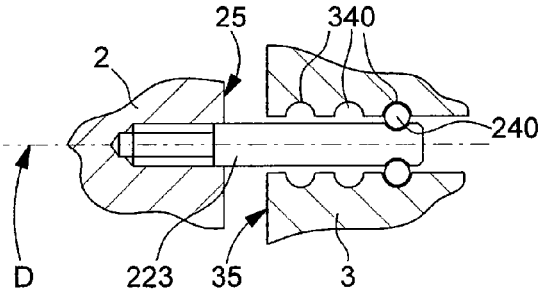
FIG. 15 shows a partial view, similar to FIG. 14, of another variant of the invention with a particular complementary locking means.

Locking means 24 and complementary locking means 34 together define at least two discrete, separate locking positions in direction D. FIG. 15 illustrates a variant with a plurality of locking positions. This plurality of positions is shown on complementary locking means 34 and it is clear that it is equally possible to make finger 223 with a plurality of radially moveable elements, or even to combine the two configurations.

Figure 14:
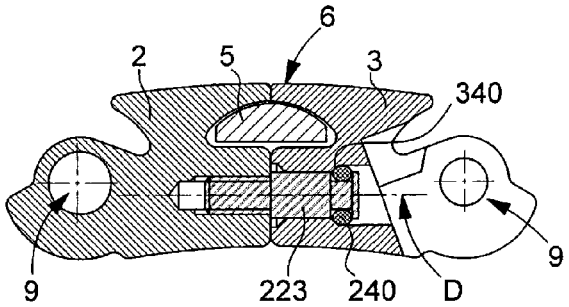
FIG. 14 shows a similar view to FIG. 5 of a variant of the invention with a particular locking means.

In an advantageous variant embodiment, seen in FIG. 14, finger 223 comprises at least one groove, in which an O-ring joint 240 or similar element is mounted, made of elastically deformable material, such as rubber or similar, whose shape at rest is substantially toric; said joint 240 forms locking means 24. This embodiment is particularly economical, and, in particular, allows miniaturisation which is advantageous for bracelets of very small size. FIG. 14 illustrates the case where second half link 3 comprises several complementary locking means 34, more than two in number, each formed in this example by a groove 340 for receiving the O-ring joint.

Preferably and as seen in FIGS. 1 to 17, first half link 2 and second half link 3 respectively comprise stopping means 22 and complementary stopping means 32, in direction D, for the captive assembly of the links in relation to each other, and to define a maximum adjustment distance between a first close position where a first bearing face 25 of first half link 2 is in contact with a second bearing face 35 of second half link 3, and a second distant position where stopping means 22 is in contact with complementary stopping means 32.

The configuration illustrated is advantageous when a blind assembly is required, as seen in FIG. 9. It is easy to provide first half link 2 with finger 223, then to insert, into the bores acting as guide means 21, the threaded pins 323 (acting as complementary guide means 31), which are screwed into second half link 3. These pins end in collars forming complementary stopping means 32 and the captive assembly is thus very easily achieved.

To change from one of the locking positions to another, a force has to be applied to one of the half links relative to the other, in direction D, either traction force, to change from the position in FIG. 8 to the position of FIG. 5, or otherwise a compression force. To convert this force in direction D into a force with a radial component of sufficient intensity to overcome the resistant force of locking means 24, a particular profile is arranged on one and/or the other of half links 2 and 3. Thus, preferably, locking means 24 and/or complementary locking means 34 comprise at least one oblique or curved ramp which, under the action of a force applied in direction D to first half link 2 and/or second half link 3, and during the relative movement between first half link 2 and second half link 3, allows locking means 24 to change from the folded position to the unfolded position or vice versa.

This ramp may be conical as in the embodiment of FIGS. 5 and 8, or in a portion of a sphere as seen in FIG. 14, or a similar shape.

In an advantageous embodiment seen in the Figures, guide means 21 is limited at one end by stopping means 22, and complementary guide means 31 is limited at one end by complementary stopping means 32.

In a particular embodiment seen in the Figures, finger 223 and channel 33 are distinct respectively from guide means 21 and complementary guide means 31.

Preferably, as seen in the Figures, finger 223 is arranged in proximity to a first bearing face 25 of first half link 2, and is adjustable in length relative thereto, for example via the cooperation of an internal and external thread. This length adjustment may also occupy discrete positions, for example if threaded finger 223 includes a collar with one or several pin holes, each indexable by pins with one or several holes comprised in first threaded half link 2.

In a preferred embodiment, which is very solid and moderately priced, guide means 21, respectively complementary guide means 31, is formed by a bore supplementary to a finger forming complementary guide means 31, respectively guide means 21; the finger is adjustable in length relative to the half link by which it is carried. This length adjustment may be achieved in a similar manner to that described above for finger 223. The Figures illustrate a preferred embodiment where stopping means 22, respectively complementary stopping means 32 is formed by a collar extending radially beyond the finger; said collar moving into a recess coaxial to guide means 21, respectively complementary guide means 31; said recess includes one end with a counterbore supporting said collar, said counterbore forming complementary stopping means 32, respectively said stopping means 22.

In the example embodiment of the Figures, guide means 21 and the associated complementary guide means 31 are doubled and extend in parallel directions to each other so as to prevent adjustable link 1 from buckling during the adjustment operation or in use. In a variant which is not illustrated in the Figures, guide means 21 and the associated complementary guide means 31 comprise at least one flat portion or similar so as to guarantee the parallelism of motion between the surfaces orthogonal to direction D of first half link 2 and second half link 3 when they are moved away from or closer to each other, whether direction D is linear or curvilinear.

As seen in the Figures and particularly FIG. 9, this type of assembly allows the half links to be assembled to each other very easily.

Advantageously, first half link 2 and second half link 3 respectively comprise a first chamber 26 and a second chamber 36, which are arranged to define a single chamber 4 when first half link 2 and second half link 3 are assembled to each other. Adjustable link 1 then comprises at least one masking element 5, arranged to be confined in single chamber 4 between first half link 2 and second half link 3, and to conceal, at least on the side of a top face 6 of the assembled adjustable link 1, the whole of the adjustment and safety mechanism formed by guide means 21 and complementary guide means 31, or particularly fingers or pins 323, stopping means 22, complementary stopping means 32, finger 223, locking means 24, channel 33, and complementary locking means 34. This masking element 5 preferably has a complementary profile to that of chamber 4.

Preferably, this masking element 5 is also arranged to conceal, via flanges 51, on two lateral faces 7, 8, adjacent to and on either side of top face 6 of adjustable link 1 in direction D, the whole of the adjustment and safety mechanism formed by guide means 21 and complementary guide means 31, stopping means 22, complementary stopping means 32, finger 223, locking means 24, channel 33, and complementary locking means 34.

To ensure that masking element 5 is pressed against the inner walls of half links 2 and 3 in proximity to top face 6, masking element 5 advantageously comprises a bearing surface 54, arranged to cooperate with at least one complementary bearing surface 29 comprised in at least one of half links 2 or 3, in order, like a cam, to hold masking element 5 abutting on the ends of the first chamber 26 and a second chamber 36 located in proximity to top face 6 of adjustable link 1. In a simple embodiment, one of bearing surface 54 or complementary bearing surface 29 is sloped relative to the other, so as to create an ad hoc transverse motion of masking element 5 when adjustable link 1 is closed or opened.

A particularly advantageous version of adjustable link 1 according to the invention is shown in FIGS. 25 to 31. Half links 2 and 3 form a frame around a central body 100 which incorporates the entire adjustment mechanism, so as to make it invisible to the user. In a non-limiting manner, central body 100 includes here, on both sides, a central recess 108 in the form of a mortise for receiving a central tenon 30 comprised in half link 3 and a wide housing 109 in the form of a notch for receiving lateral studs 20 and a central stud 110 comprised in half link 2. Naturally, other configurations may be envisaged, particularly with one or more tenons on central body 100 or one or more mortises on the half links; these tenon-mortise embodiments hold the rest of the bracelet properly relative to adjustable link 1, substantially in the alignment of central body 100 for the first links.

Figure 31:
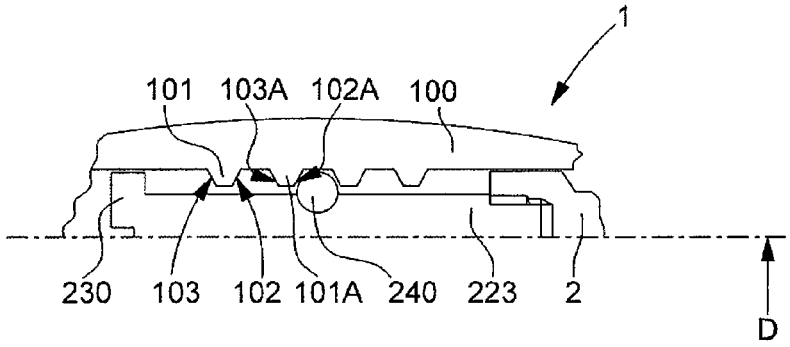
FIG. 31 is a detail of a multiple adjustment variant with several ribs corresponding to as many pairs of adjustment positions.
Figure 32:
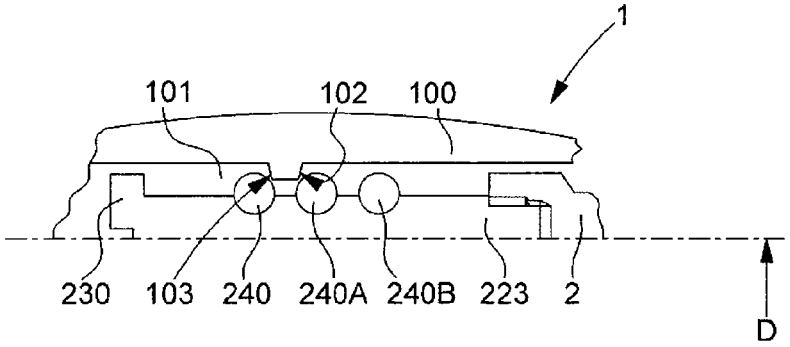
FIG. 32 is a detail of a multiple adjustment variant with several joints corresponding to as many pairs of adjustment positions.
Figure 24:
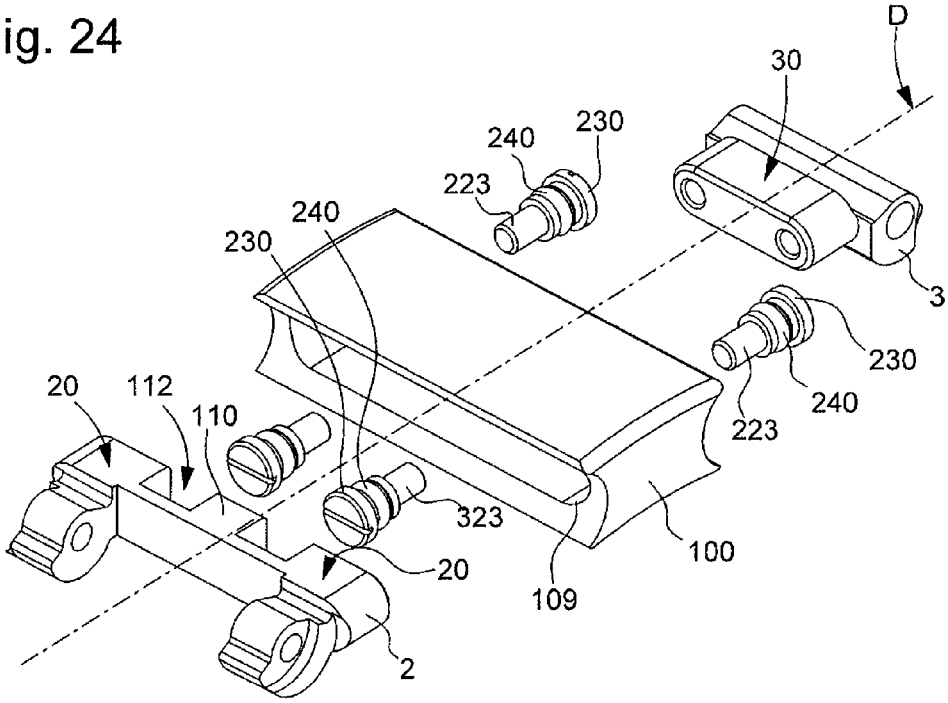
FIGS. 24 and 25 show schematic, exploded, perspective views of yet another variant of an adjustable link of the invention, comprising a central body with respect to which two half links are separately moveable.
Figure 25:
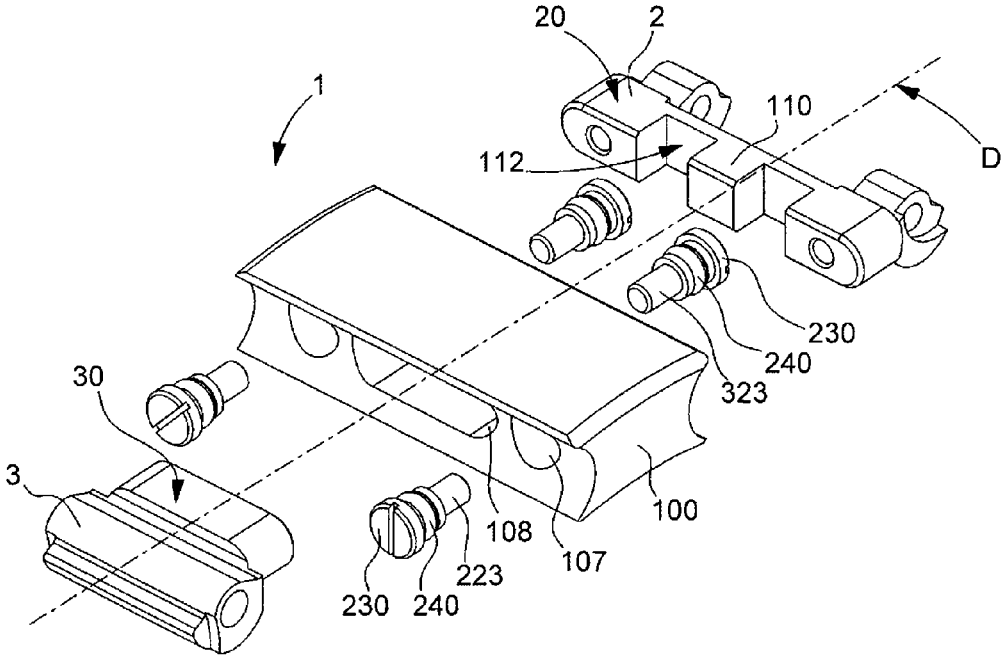
Figure 26:
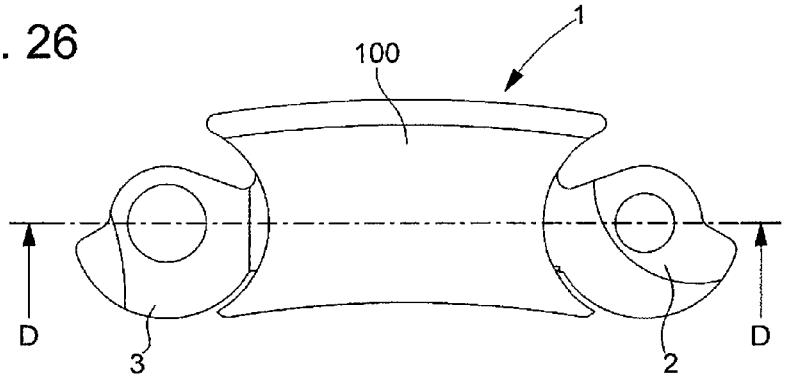
FIG. 26 is a schematic side view of the variants of FIGS. 24 and 25 in a position of minimum dimension, corresponding to FIG. 27 which is a top cross-sectional view on a plane parallel to the direction of adjustment and through the axes of the adjustment components comprised in the adjustable link.
Figure 27:
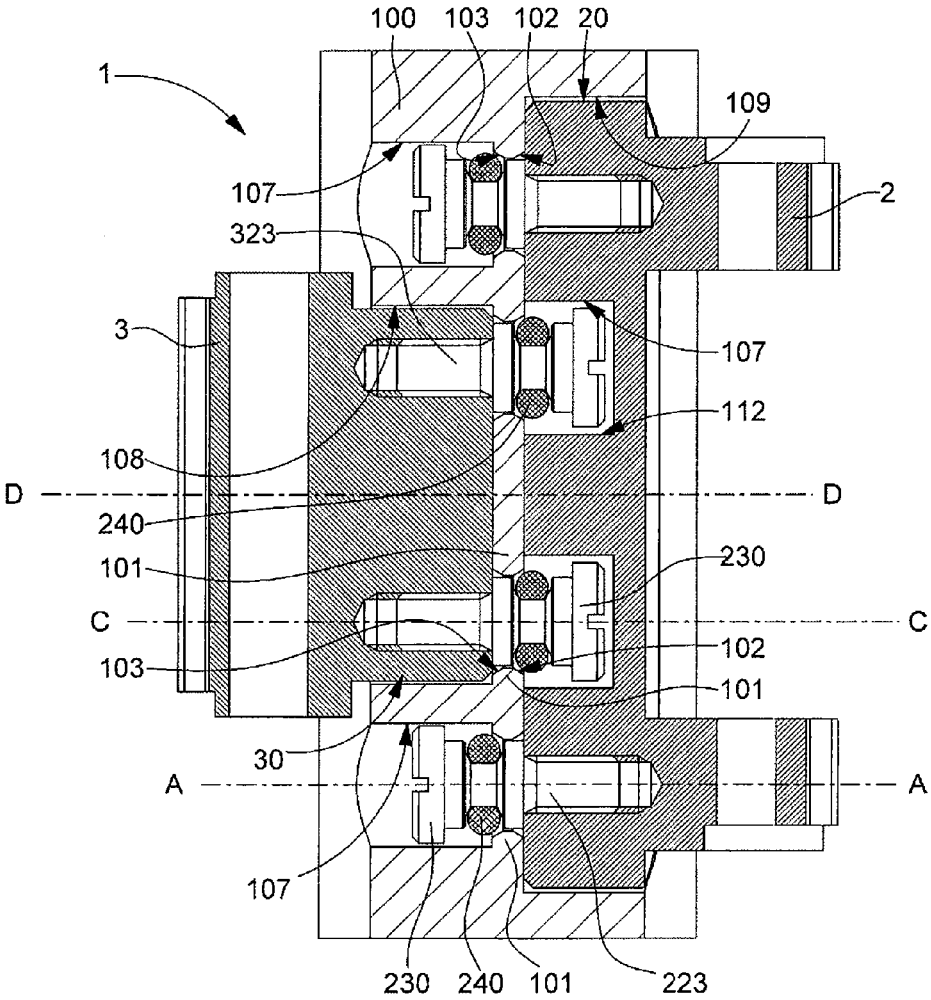
Figure 28:
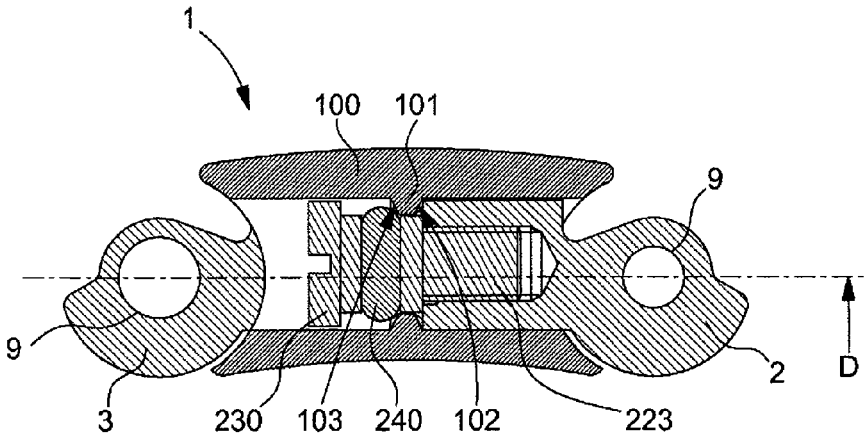
FIG. 28 is a cross-section, along plane AA of FIG. 27, in an adjustment position of minimum dimension.
Figure 29:
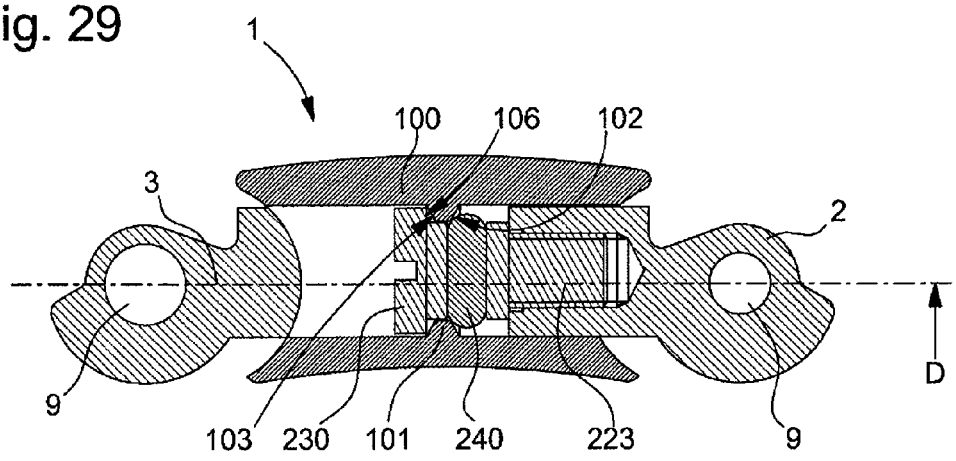
FIG. 29 is a cross-section, along plane AA of FIG. 27, in an adjustment position of maximum dimension.
Figure 30:
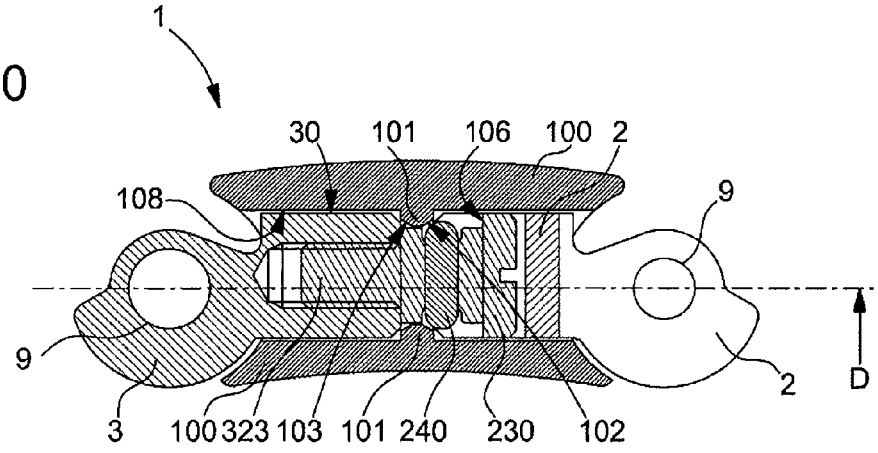
FIG. 30 is a cross-section, along plane CC of FIG. 27, in an adjustment position of maximum dimension.

At least first half link 2 or second half link 3 and preferably each half link 2, 3 comprises at least one guide means 23, particularly at least one finger, with stopping means 32, particularly a head or screw head 230. In the version illustrated in the Figures, each finger 223, 323, is respectively screwed onto one of half links 2, 3 and comprises a head 230, one surface of which forms said stopping means 32. Each half link 2, 3 carries at least one locking means 24, comprising here at least one O-ring joint 240 elastically mounted in a groove of finger 223 or respectively 323. Each head 230 moves in a chamber 107 of the other half link 3, 2, one wall of which defines complementary end of travel stop means for stopping means 32. Recesses 112 or similar are provided for housing certain screw heads. Joint 240 cooperates in abutment with at least one complementary locking means, and more particularly, in the illustrated version, with at least one stud or rib 101 comprised in central body 100, defining on each side a lateral recess 102, 103, in which joint 240 can be stopped on rib 101, on one side or the other of said rib. Each of these recesses 102, 103 thus corresponds to a particular relative position of the half link 2 or 3 which carries joint 240 relative to central body 100. FIG. 31 illustrates a particular arrangement with several ribs 101, 101A, . . . , defining as many recesses 102, 103, 102A, 103A, . . . , and thus as many positions of joint 240, and thus of the half link 2 or 3 carrying said joint. FIG. 32 illustrates a reverse configuration where finger 223 carries several joints 240 cooperating in turn with the same rib 101. It is thus possible to produce an adjustable link 1 with several discrete positions. The model illustrated in FIGS. 25 to 30 comprise three adjustment positions: the shortest with the two half links 2 and 3 completely pushed into central body 100, the longest with the two half links 2 and 3 as far out of central body 100 as possible and an intermediate position where one of the two half links is completely pushed into central body 100, while the other is as far out as possible. Of course, if the distances travelled by the fingers 23 attached to half links 2 and 3 are different, it is then possible to define two intermediate positions instead of one, depending upon whether the user moves first half link 2 or second half link 3 relative to central body 100. Naturally, the simplest movement for the user is to pull the two bracelet strands gripping the adjustable link, and thus to perform the adjustment at a maximum distance, which also provides the advantage of a particularly attractive symmetry. Since this type of adjustable link is robust, attractive and of moderate production cost, it can be used several times in the same watch bracelet. For example, the use of two adjustable links each having a travel of 1.5 mm, symmetrically arranged relative to the clasp, provides a total adjustment capacity of 3 mm.

Naturally, this variant can be modified, in a similar manner to that of FIG. 9, to comprise only one adjustment element formed by one or several fingers 223 or respectively 323, the other fingers 323, respectively 223 then being arranged with only one stop collar or similar stop member; the adjustment is then only performed on one side. This configuration is less advantageous as regards adjustment amplitude, but may allow a watch bracelet to be fitted with an adjustable link arranged immediately after the horns, preferably on each side of the watch case.

In a variant, the elastic joint 240 is held between rib 101 and another stop surface, for example another rib of the same type, as seen in FIG. 31.

Preferably, first half link 2 and second half link 3 each include at least one finger 223, respectively 323; the fingers each comprise opposing stopping means 32 making adjustable link 1 captive.

Central body 100 entirely covers the adjustment mechanism, which remains perfectly clean. Adjustable link 1 rests, via a lower portion of central body 100, on the user's wrist and the user does not experience any discomfort during adjustment, which he can conveniently perform with a single hand with the bracelet or watch on his wrist.

Figure 33:
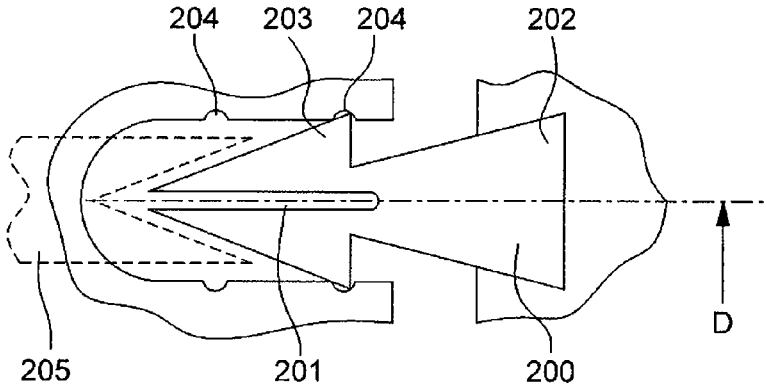
FIG. 33 is a detail, in a top view, of yet another variant of the adjustable link according to the invention, with an elastic wedge spring.
Figure 34:
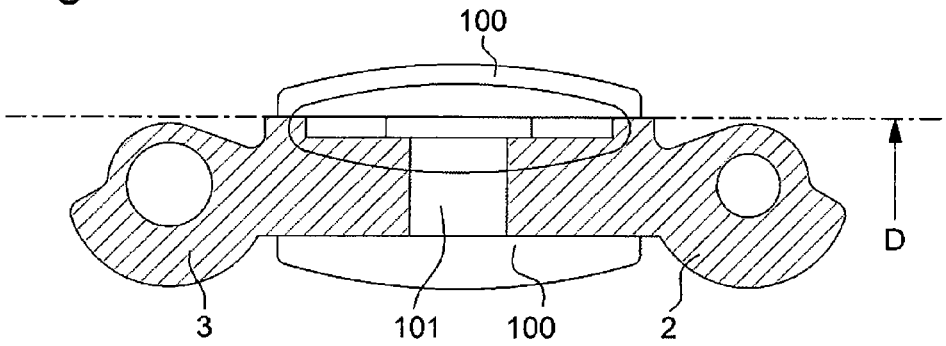
FIG. 34 is a longitudinal cross-section of the link of FIG. 33.
Figure 35:
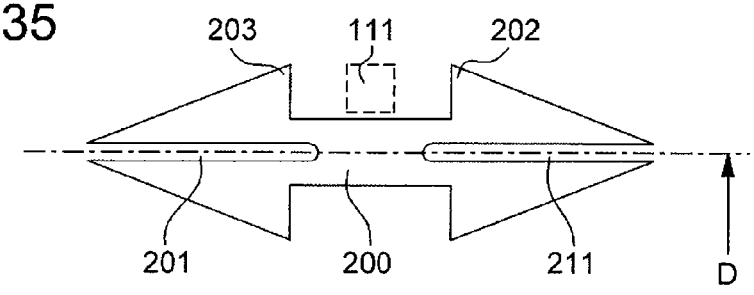
FIG. 35 is a variant of the wedge spring of FIG. 33.

FIGS. 33 to 35 illustrate another variant embodiment, which has the advantage of being very flat, and which is also streamlined by a central body 100. The elastic locking element 24 is formed here by a preferably flat wedge spring 200, in the shape of a single arrow or double arrow in FIG. 35.

This wedge spring 200, made for example of spring steel or similar, is preferably symmetrical in direction D and has one or several elastic slots 201, 211. It also comprises a corner fastening 202 for the first half link 2. FIG. 33 shows a corner fastening 202 in a fixed position relative to first half link 2, which comprises a notch, or dovetail, or similar, of complementary profile to that of corner 202. An elastically deformable front portion opposite the slot or slots comprises at least one adjustment corner 203 cooperating with at least one adjustment notch 204 of second half link 3, among a plurality of adjustment notches 204 carried by second half link 3. The change from one to the other is made possible by the compression of wedge 200, resulting from a traction or thrust force in direction D. FIG. 35 illustrates a variant where corner fastening 202 is also an adjustment corner, and thus moveable relative to first half link 2, with respect to adjustment notches 204 carried by first half link 2, unlike FIG. 33 where it is not moveable. A rib 101 of central body 100, or a travel limiter stud 111, advantageously limits the travel of wedge spring 200. For easy disassembly, a tool 205 with a V-shaped end pushed against wedge spring 200 tends to close slot 201, and thus releases corners 203 from notches 204 and thus separates the two half links, and therefore completely dismantles adjustable link 1.

Figure 16:
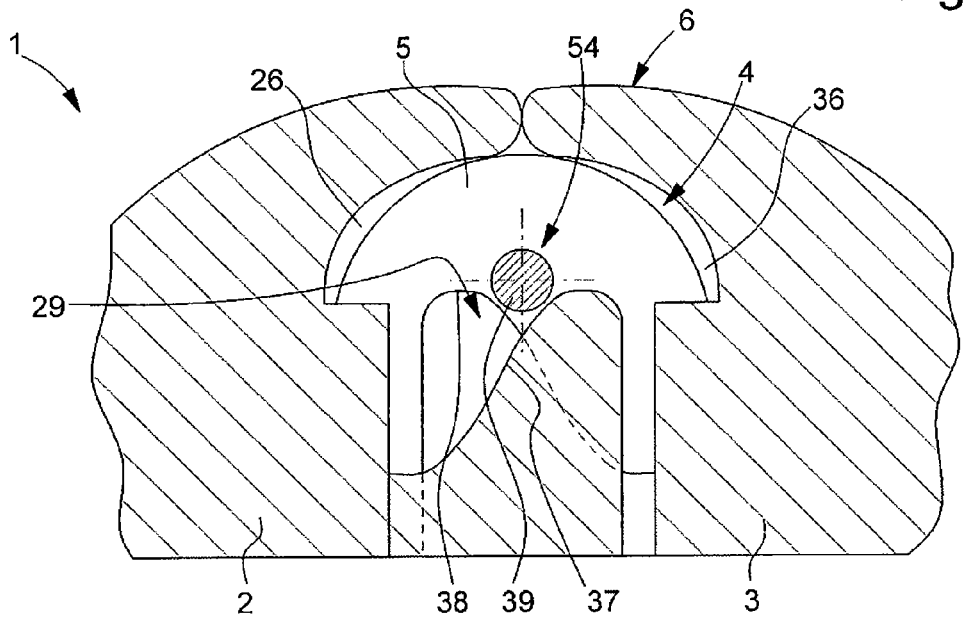
FIG. 16 shows a schematic, partial, longitudinal cross-section, along a plane parallel to a direction of mobility of the adjustable link, of a detail of an operating mechanism of a masking element of the invention, in the folded position of the adjustable link.
Figure 17:
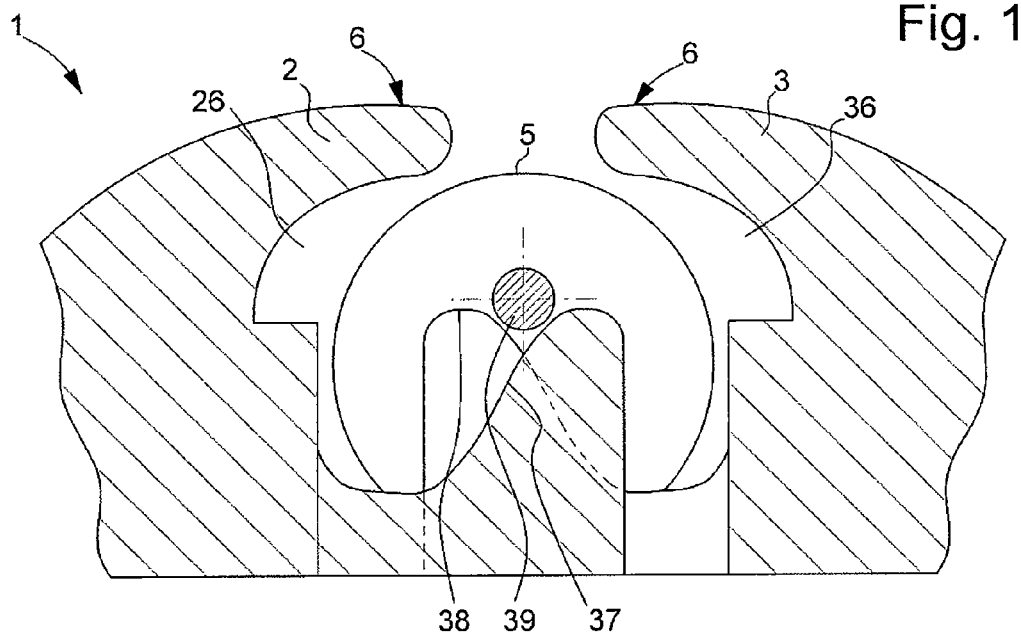
FIG. 17 shows the mechanism of FIG. 16, in the unfolded position of the adjustable link.
Figure 18:
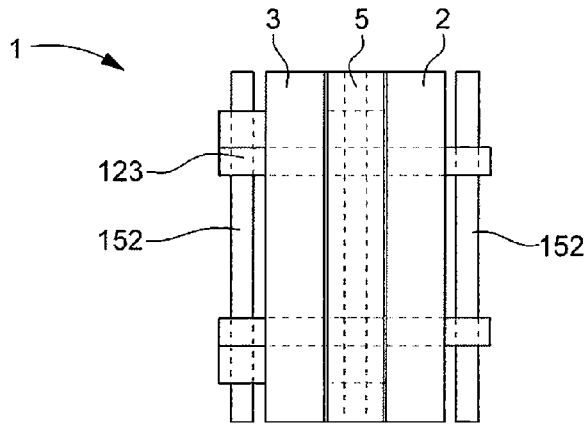
FIG. 18 shows a schematic top view of another variant of the adjustable link of the invention, locked in an unfolded position.
Figure 19:
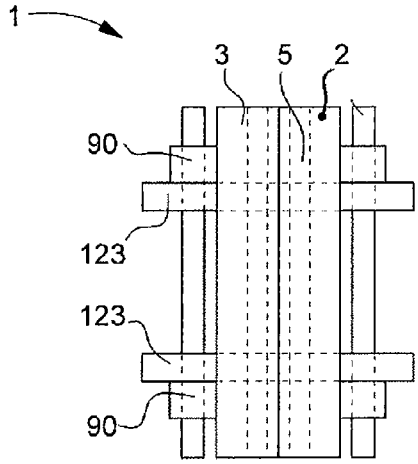
FIG. 19 shows a similar view to FIG. 18 of the same adjustable link, locked in a folded position.
Figure 20:
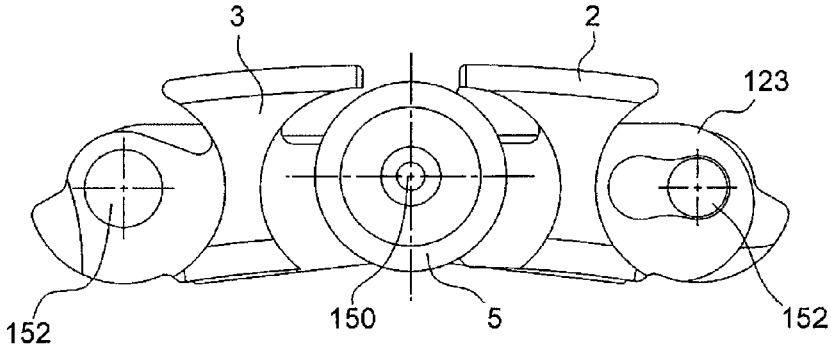
FIG. 20 shows a schematic side view of the adjustable link of FIG. 18, in the unfolded position.
Figure 21:
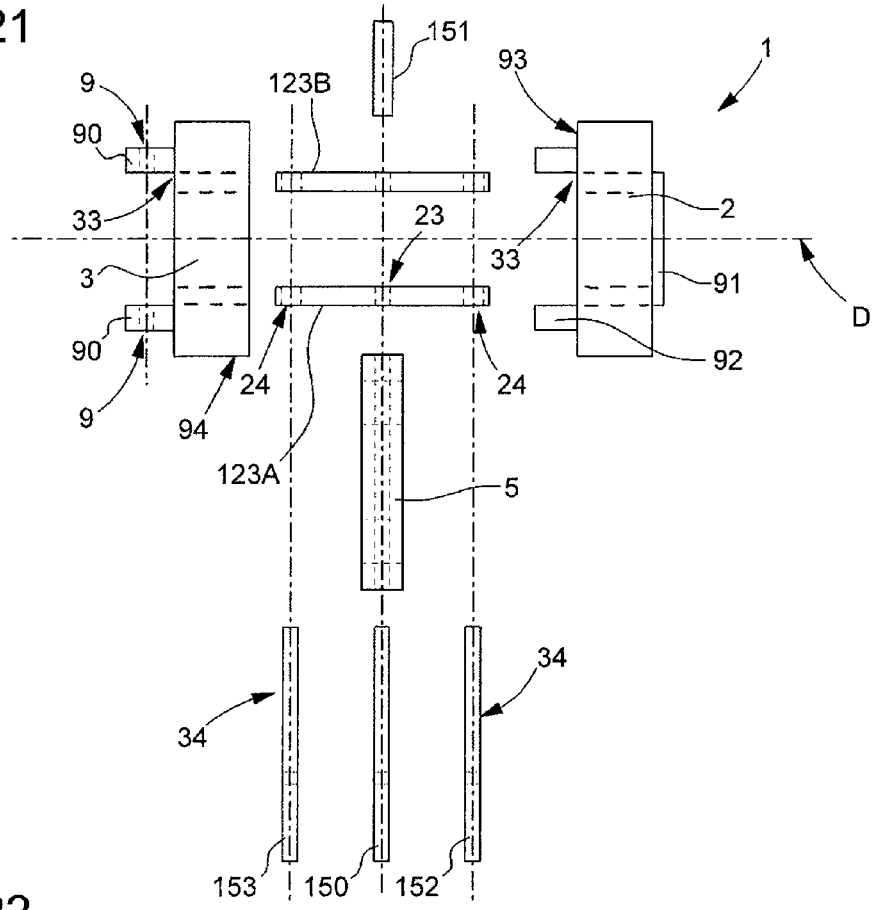
FIG. 21 shows a schematic, exploded, top view of the adjustable link of FIG. 18.
Figure 22:
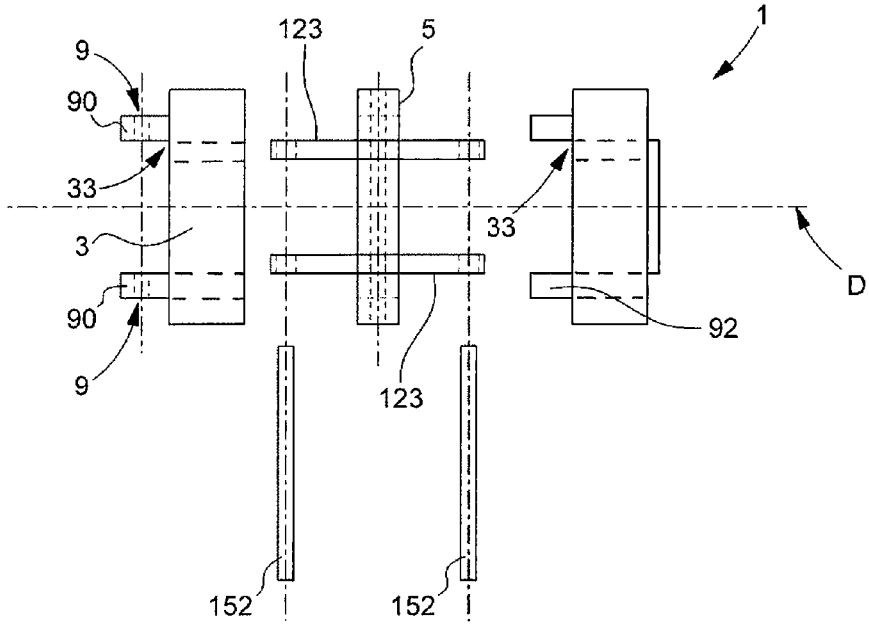
FIG. 22 shows, in a similar manner to FIG. 21, an intermediate assembly step of the adjustable link of FIG. 18, with a median masking element pre-assembled on two flanges and captived thereto by a median pin.

In an example embodiment illustrated in FIGS. 16 and 17, the bearing surface 54 of the masking element is a journal 39 carried by two ramps 37 and 38 captived respectively to first half link 2 and second half link 3, arranged in a cross, so as to move journal 39 transversely further away or closer, substantially orthogonally to direction D, when the half links are moved closer to or away from each other.

In a variant, flanges 51 each include a screw 53, forming a bearing surface 53, the end of which is housed in a lateral groove, forming a complementary bearing surface 29, comprised in one of the half links, for example second half link 3, for adjusting the distance from masking surface 5 to top face 6. This distance may be constant if the lateral groove is parallel to direction D, or may be variable, as seen in the change of position illustrated in FIGS. 5 and 8, when the lateral groove is devised to press masking element 5 at the ends of first chamber 26 and a second chamber 36 located in proximity to top face 6 of adjustable link 1.

Figure 10:
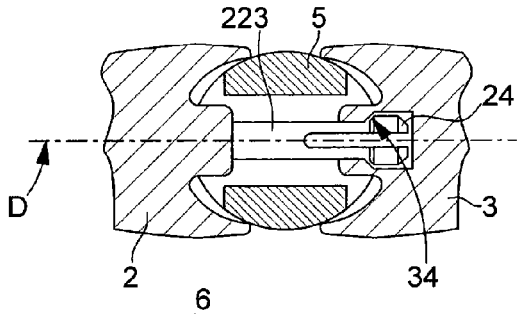
FIG. 10 shows a schematic, partial view similar to FIG. 5 of a variant of the invention with a particular masking element.

In another simplified variant, seen in FIG. 10, masking element 5 is arranged to conceal the adjustment and safety mechanism on both sides of the mechanism, without however being moveable.

In another variant not illustrated in the Figures, masking element 5 is not restricted in chamber 4 and is simply returned against the top face 6 of adjustable link 1 by a strip spring on the bottom portion thereof, or similar device.

Masking element 5 is made, in the illustrated embodiments, in the form of a hollowed cylindrical sector and delimited by two flanges 51.

In a preferred embodiment, since it is very economical, direction D is linear.

For fastening to a bracelet or piece of jewellery or timepiece, each half link 2, 3 comprises a means 9 of attachment to a bracelet strand or similar.

The invention also concerns a bracelet 10 comprising at least two bracelet strands and comprising at least one adjustable link 1 attached by said attachment means 9 to the bracelet strands.

The invention thus satisfies the designated objects, acts in the longitudinal direction of the bracelet, with an adjustable mechanism using no particular tools, where the adjustment mechanism remains hidden and comprises return means for returning the adjustable link to its shortened position. The mechanism is adaptable to non-linear shapes and allows easy adjustment in complete security, without any risk of the bracelet being lost.

The invention claimed is:

1. An adjustable link for a bracelet, comprising:

at least one first half link and at least one second half link which are moveable in relation to each other in one direction, and which form a captive unit, wherein:

said first half link either comprises at least one connecting and locking member, or is assembled fixedly or with restricted mobility in said direction with at least one connecting and locking member; said connecting and locking member extending in said direction and comprising a locking means;

said second half link either includes a complementary locking means or is assembled fixedly or with restricted mobility in said direction with a complementary locking means;

said locking means and said complementary locking means together define at least two locking positions for immobilizing said first half link with respect to said second half link, said positions being discrete and separated from each other in said direction;

said locking means and/or said complementary locking means are moveable, under action of a force that is exerted in said direction and is greater than a given value, against elastic return means respectively comprised in said complementary locking means and/or said locking means, to allow a relative change of position between said first half link and said second half link in said direction.

2. The adjustable link according to claim 1, wherein said second half link comprises at least one recess which extends in said direction and is arranged to allow said connecting and locking member to pass to be held in only one of said discrete locking positions, and wherein said complementary locking means is arranged in proximity to said channel.

3. The adjustable link according to claim 1, wherein said connecting and locking member comprises at least one flange which extends in a parallel plane to said direction, and which includes at least one oblong hole extending in said direction and comprising at least one constricted portion on either side of which said hole delimits two chambers, each capable of housing a pin with minimum play, said hole being made in an elastically deformable area of said flange to allow said pin to pass through said constricted portion when said pin is subjected to a force in said direction against said constricted portion, said force being of sufficient intensity to overcome an elastic return force exerted on said pin by said constricted portion and said hole, said pin and said hole forming said locking means and said complementary locking means.

4. The adjustable link according to claim 3, wherein said flange comprises at least one other oblong hole extending in said direction and comprising at least one constricted portion on either side of which said hole delimits two chambers, each capable of housing a pin with minimum play, said hole being made in an elastically deformable area of said flange to allow said pin to pass through said constricted portion when said pin is subjected to a force in said direction against said constricted portion, said force being of sufficient intensity to overcome an elastic return force exerted on said pin by said constricted portion and said hole, said pin and said hole together forming a means of assembling said first half link with said connecting and locking member comprising said flange with restricted mobility, in discrete positions, in said direction.

5. The adjustable link according to claim 3, wherein, on the side opposite said first half link, said second half link comprises at least one cap including a bore for receiving one said pin with minimum play, so as to confine said flange inside said recess, in one of said discrete locking positions thereof, said pin also being arranged to form a hinge pin of one end of a bracelet, and/or wherein said first half link comprises at least one recess which extends in said direction and is arranged to allow said connecting and locking member to pass, and comprises, on the side opposite said second half link, at least one cap including a bore for receiving one said pin with minimum play, so as to confine said flange inside said recess, in one of the discrete positions thereof, said pin being further arranged to form a hinge pin of one end of a bracelet.

6. The adjustable link according to claim 1, further comprising at least one masking element confined between said first half link and said second half link, mounted in abutment on at least one said connecting and locking member, and held thereon by at least one pin which passes through both said masking element and said connecting and locking member.

7. The adjustable link according to claim 1, wherein said at least one first half link and said at least one second half link are guided in relation to each other via cooperation of a guide means and a complementary guide means, and form a captive unit via cooperation of an stopping means and a complementary stopping means, and said connecting and locking member comprises at least one finger extending in said direction and comprising a locking means which has substantially radial elastic return relative to said direction and which is moveable between a folded position and an unfolded position, and said second half link includes at least one channel which extends in said direction and is arranged to allow said finger to pass in only one of said folded or unfolded positions of said locking means, and wherein, in proximity to said channel, said second half link further includes a complementary locking means arranged to cooperate, in at least one locking position, with said locking means in the other of said unfolded or folded positions of said locking means, and wherein said locking means and said complementary locking means together define at least two said discrete separate locking positions in said direction.

8. The adjustable link according to claim 7, wherein said first half link and said second half link respectively comprise said stopping means and said complementary stopping means, in said direction for the captive assembly of said links in relation to each other, and to define a maximum adjustment travel between a first close position where a first bearing surface of said first half link is in contact with a second bearing surface of said second half link, and a second distant position where said stopping means is in contact with said complementary stopping means.

9. The adjustable link according to claim 7, wherein said locking means and/or said complementary locking means comprise at least one ramp which, under action of a force applied in said direction to said first half link and/or said second half link, and during relative movement between said first half link and said second half link, allows said locking means to change from the folded position to the unfolded position thereof or vice versa.

10. The adjustable link according to claim 7, wherein said guide means, respectively said complementary guide means, is formed by a bore supplementary to a finger forming said complementary guide means, respectively said guide means, said finger being adjustable in length relative to the half link which carries said finger.

11. The adjustable link according to claim 7, wherein said first half link and said second half link respectively comprise a first chamber and a second chamber arranged, when said first half link and said second half link are assembled to each other, to define a single chamber, and wherein said adjustable link comprises at least one masking element arranged to be confined inside said single chamber between said first half link and said second half link, and to conceal, at least on a side of a top face of said assembled adjustable link, said guide means, said complementary guide means, said stopping means, said complementary stopping means, said finger, said locking means, said channel, and said complementary locking means.

12. The adjustable link according to claim 1, wherein said first half link and said second half link form a frame around a central body which incorporates an entire adjustment mechanism, and wherein at least said first half link or said second half link includes at least one guide means formed by at least one finger comprising stopping means, and carrying at least one locking means including at least one elastic O-ring joint, which is mounted in a groove of said finger and which cooperates in abutment with at least one complementary locking means formed by a rib carried by said central body, defining a lateral recess on each side of said rib, in which said joint can be stopped on one side or other of said rib.

13. The adjustable link according to claim 12, wherein said first half link and said second half link each include at least one said finger, said fingers each including opposing stopping means making said adjustable link captive.

14. The adjustable link according to claim 1, wherein said first half-link and said second half-link form a frame around a central body which incorporates an entire adjustment mechanism, and wherein said adjustable link comprises at least one elastic locking element, formed by a flat wedge spring in a shape of a single or double arrow, comprising at least one elastic slot, and comprising at least one corner fastening for said first half link and comprising an elastically deformable front portion opposite said at least one slot and which comprises at least one adjustment corner cooperating with an adjustment notch of said second half link among a plurality of adjustment notches carried by said second half link, the change from one notch to another being possible by compression of said wedge resulting from a traction or thrust force in said direction.

15. The adjustable link according to claim 14, wherein said corner fastening is also an adjustment corner which is moveable relative to said first half link between a plurality of said adjustment notches carried by said first half link.

16. A bracelet comprising:

at least two bracelet strands; and at least one adjustable link according to claim 1, wherein each half link comprises a means of attachment to a bracelet strand, and which is attached by said attachment means to said bracelet strands.

* * * * *